United States Patent [19]

Larsen

[11] Patent Number: 4,668,123

[45] **Date of Patent: * May 26, 1987**

[54] BARRIER STRUCTURE AND METHOD OF PRODUCING AND LAYING IT

[76] Inventor: Ole F. Larsen, P.O. Box 3002, 6700 Esbjerg, Denmark

[ * ] Notice: The portion of the term of this patent subsequent to Sep. 17, 2002 has been disclaimed.

[21] Appl. No.: 706,787

[22] Filed: Feb. 28, 1985

Related U.S. Application Data

[62] Division of Ser. No. 336,356, Dec. 18, 1981, Pat. No. 4,541,751.

[30] Foreign Application Priority Data

| | | | |
|---|---|---|---|
| May 10, 1980 | [GB] | United Kingdom | 8015539 |
| Jun. 18, 1980 | [GB] | United Kingdom | 8019836 |
| Jul. 10, 1980 | [GB] | United Kingdom | 8022565 |
| Feb. 9, 1981 | [GB] | United Kingdom | 8103842 |
| Apr. 10, 1981 | [GB] | United Kingdom | 8111438 |

[51] Int. Cl.[4] ..... E02D 3/00; E02D 17/00

[52] U.S. Cl. ..... 405/15; 405/17

[58] Field of Search ..... 405/15, 17, 18, 38, 405/116, 117, 156, 176, 258

[56] References Cited

U.S. PATENT DOCUMENTS

| | | | |
|---|---|---|---|
| 1,787,902 | 1/1931 | Herfort | 405/176 X |
| 3,217,500 | 11/1965 | Diamond et al. | 405/156 |
| 3,415,062 | 12/1968 | Ziegenmeyer | 405/117 |
| 3,570,254 | 3/1971 | Turzillo | 405/18 |
| 3,590,588 | 7/1971 | Draper et al. | 405/176 |
| 4,541,751 | 9/1985 | Larsen | 405/15 |

FOREIGN PATENT DOCUMENTS

| | | | |
|---|---|---|---|
| 570879 | 9/1958 | Belgium | 405/17 |
| 1221687 | 2/1971 | United Kingdom | 405/17 |

*Primary Examiner*—David H. Corbin

*Attorney, Agent, or Firm*—Diller, Ramik & Wight

[57] ABSTRACT

A method of constructing a barrier upon an underwater surface by storing sheet material as a rolled web, unrolling the web, continuously forming the web into a longitudinal hollow of a tube-like configuration, progressively positioning spaced longitudinal slot-defining edge portions defining the underside of the longitudinal hollow upon an underwater surface, thereafter delivering ballast material through and between the spaced edge portions into the longitudinal hollow and into overlying relationship upon the edge portions to hold the edge portions upon the underwater surface, and the ballast material being delivered through a portion of the longitudinal hollow as the web is unrolled but the longitudinal hollow is not yet positioned upon the underwater surface.

18 Claims, 15 Drawing Figures

BARRIER STRUCTURE AND METHOD OF PRODUCING AND LAYING IT

This application is a division of application Ser. No. 06/336,356, filed Dec. 18, 1981, now U.S. Pat. No. 4,541,751.

TECHNICAL FIELD

The invention relates to a barrier for control of erosion on land due to wind, or erosion in a body of water due to waves and currents. On land the barrier may be used for instance for dune, bank or beach stabilization, in water for example for coastal protection, prevention of siltation is a waterway, prevention of erosion along a submarine installation such as a pipeline, and the like.

BACKGROUND ART

Various gravity types of prefabricated groins and breakwaters exist. Made of concrete, stones or other heavy materials, they have either solid cross-section or are formed as shell-like ridge-structures. As these heavy structures are kept in place by their own weight, costly anchoring in the seabed is avoided.

The drawback of these heavy barriers is the expensive transportation of them from factory to installation site.

Other prefabricated systems consist of light materials, such as plastic, and therefore have to be anchored. For example, British Pat. No. 1383011 presents a system consisting of a sheet which, in use, forms a ridge-like barrier anchored in the seabed.

Danish Pat. No. 121080 presents a special method of filling a closed, circular hose of flexible material with sediment pumped into the interior of the hose.

Such circular cross-section of the structure, however, is inappropriate for fulfillment of most of the above objective of the present invention. A circular-cylindrical body is unstable, as it is undermined by waves and currents.

DISCLOSURE OF INVENTION

The present structure has little weight and thereby avoids expensive transportation. One or more hollows occupies the whole interior of the structure, which, when laid, is filled with natural sedimentary ballast, preferably taken from the area adjacent to the installation site, so that anchoring is avoided.

The structure has a wide base and thereby avoids undermining by waves and currents.

The barrier comprises an inexpensive, hollow, elongate structure with any suitable cross-section with a height/base width ratio less than 1. The ballast material is placed artificially and/or naturally in at least part of the hollows of the barrier, preferably during or immediately after laying of the barrier.

BRIEF DESCRIPTION OF THE DRAWINGS

While the fields of application of the present invention cover uses above as well as under water, a full and complete understanding of the invention may be had by reference to the description of preferred embodiments relating to underwater uses as set forth hereinafter and as may be seen in the accompanying drawings in which.

The construction material of the barrier may be rigid or flexible, or a combination of rigid and flexible materials. The structure may consist of a sheet 13, FIGS. 1, 8, 9, enclosing the ballast material 19, or a thicker, porous material 1, FIGS. 11–12, in which at least part of the pores are filled with ballast material, or a combination hereof, FIG. 10.

Figure 8:
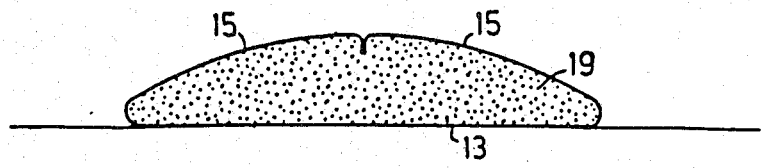
FIGS. 8–12 are cross-sections of alternative shapes and materials of the barrier.
Figure 9:
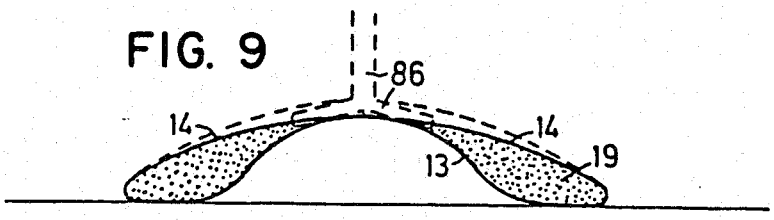
Figure 10:
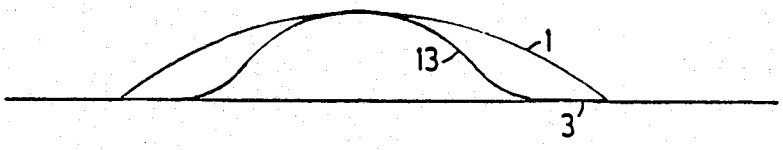

In the first case the sheet 13 may be pre-shaped, FIGS. 8–10, and rigid enough to assume and/or maintain its final shape when it is laid on the floor. The sufficient rigidity may be obtained by corrugating the sheet 13, and/or by means of ribs in its transverse and/or longitudinal directions.

The spaces to be filled with ballast material 19 are formed by the edge portions 14, 15 or 16, which are bent 180° around. The edges may be rounded, FIGS. 1, 9, or sharp.

Alternatively, the sheet material may not be pre-shaped, and the desired shape of the cross-section of the barrier obtained by bending the edge portions of the sheet around, during the installation operation, FIGS. 1–6. The edge portions 16, FIG. 1, and thereby the whole barrier, are kept in place by the weight of the ballast material 19.

To prevent the fill material 19 from being washed out through the ends of the barrier, these should be closed, for instance by joining the lower portions 16 to the upper portion 13, e.g. by stapling them together.

In stead of bending the edge portions of the sheet 13 downwards, they may be bent upwards and interconnected, so that a closed tube is formed, FIG. 8.

FIG. 9 is a cross-section of a barrier where the center portion of the pre-shaped sheet 13 is upwardly arched and the edge portions 14 are bent upwardly around to meet the arched center portion and thereby enclose two longitudinal hollows.

The connections in FIGS. 8–9 may be obtained by connecting means attached to the edges, or by interlocking configurations of these.

If the sheet 13 is rigid enough and/or the dimensions of the barrier are small, the elasticity of the sheet 13 by itself may be sufficient to keep the tubes closed, after they have been filled with sediment 19, FIGS. 8–9.

FIG. 10 is a cross-section of a barrier consisting of a pre-shaped sheet 13, combined with porous material 1.

Figure 11:
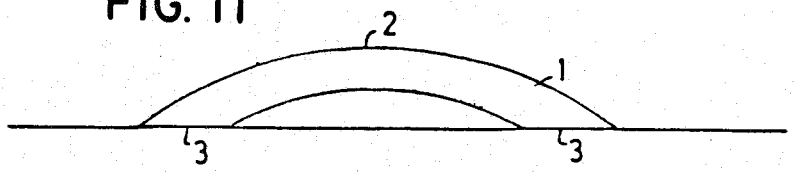
Figure 12:
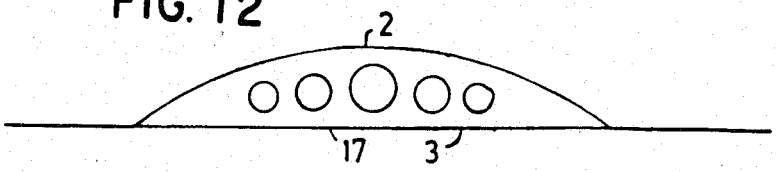

Examples of barriers consisting of porous material 1 are shown in FIGS. 11–12. To minimize the resistance of the barrier against being flattened out and wound up, the cross-section of the barrier may arched, FIG. 11. The barrier may contain cavities 17 to save material, FIG. 12.

Figure 1:
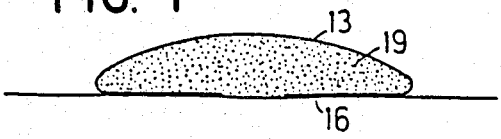
FIG. 1 is a cross-section of a completed barrier.
Figure 2:
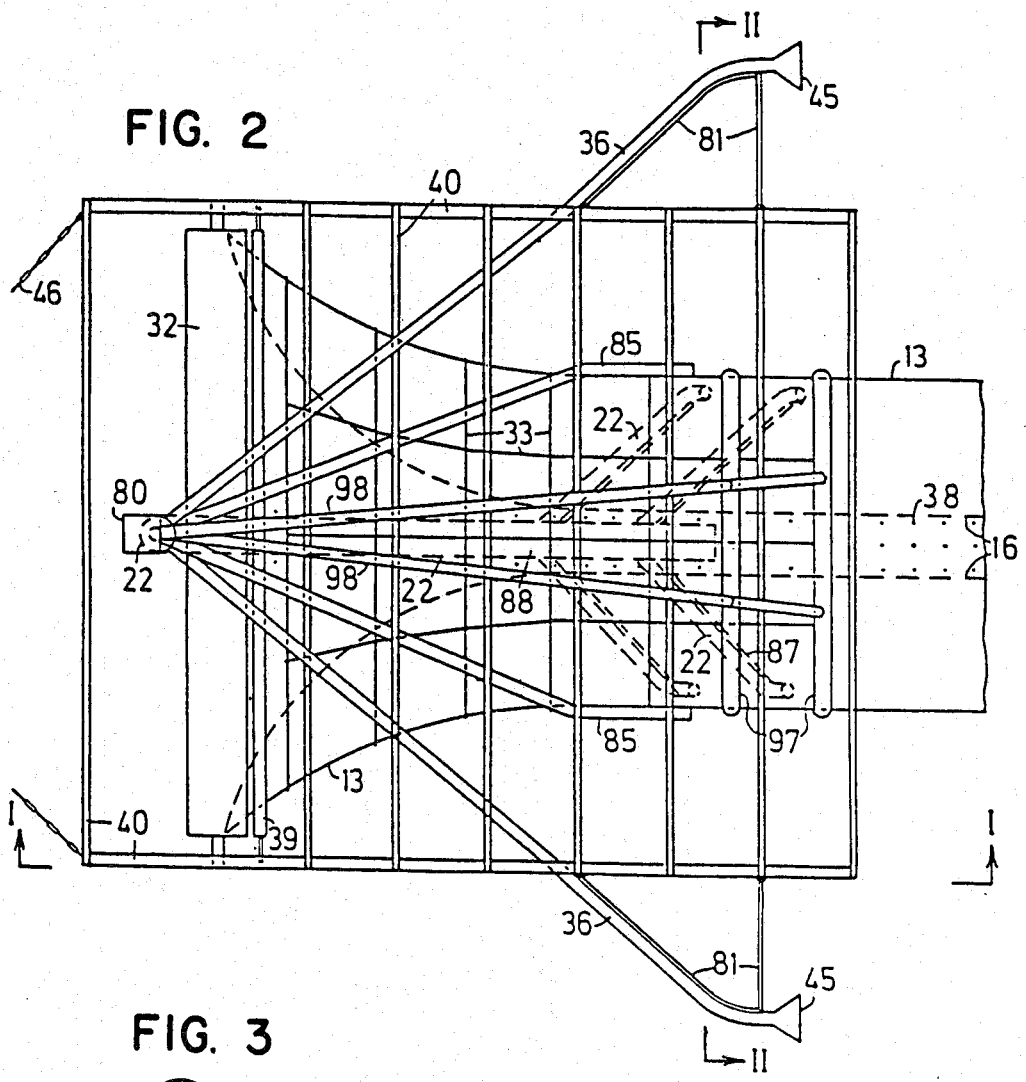
FIG. 2 is a plan view of an underwater sled for producing and laying the barrier shown in FIG. 1.
Figure 3:
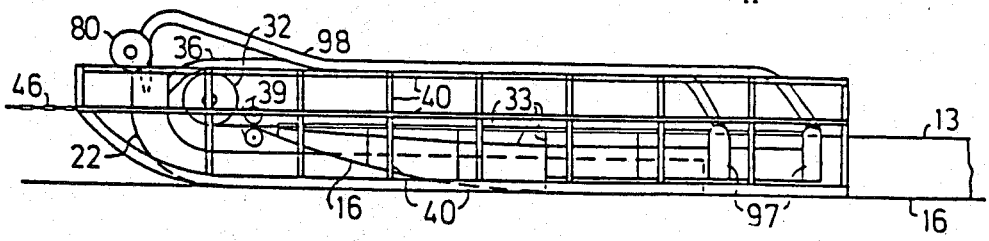
FIG. 3 is a section along the line I—I in FIG. 2.

The sheet 13, 16, FIG. 1, may be made of water-impermeable, elastic material, e.g. polypropylene, polyethylene, aluminium or steel. The thickness of the sheet may vary over the cross-section of the barrier. For example, the edge portions 16 may be thinner than the center portion.

Relief of pressure differences between the two sides of the sheet may be achieved by means of holes 38 placed at appropriate locations of the surface. And at least part of the water of the water/sediment mixture may escape through such holes. To prevent the sediment 19 from being washed out through the holes 38, these may be supplied with filter cloth. Or the edges of the holes may be bent outwards or inwards, so that each hole forms a funnel preventing the current from drawing the sediment 19 out through the hole.

Alternatively, all of the sheet 13 may consist of a water-permeable, flexible filter cloth, e.g. consisting of non-woven polypropylene and/or polyester fibres welded together by a heating process. To strengthen the cloth, for instance against vandalism, it may be reinforced with resistable threads, made for example of metal.

The pores of the filter material should be so small, that only an insignificant part of the smallest particles of the sediment 19 can pass through. Such filter material also has the advantage that a part of the water of the water/sediment mixture can pass through the sheet, although the major part may have to escape underneath the sheet 13 at the front end of the sled 40. Another advantage of filter material is the fact that the tendency of the wave action to cause flapping of the sheet 13 and thereby deformation of the barrier is much less than for an impermeable and/or more rigid sheet.

The voids of a barrier consisting of porous material 1, FIGS. 10–12, may be open hollows. Preferably the cells are parallel, narrow and extend vertically throughout the height of the barrier, the upper end of each cell being open, so that the ballast material can deposit in the cell, and the lower end being closed, so that the ballast material is retained in the cell. The cross-section of the individual cell may be hexagonal, quadrangular, circular, or shaped otherwise.

Alternatively, or in combination with such kind of cellular structure, the barrier may consist of a tangle of crisscross threads that are straight, crooked, wavy and/or looped, and twisted or welded together to form a very open and permeable structure 1.

Generally, the spacing of the threads in the tangle of threads only has to be tight enough to reduce the velocity of the wind or the current and orbital motion of the waves to such level that the fill material in the hollows of the barrier will not be removed. In some areas of the barrier, however, the surface appropriately is tighter: (1) To prevent the fill 19 from slipping through, at least the lower periphery of the compartments intended for containing the fill should be tight enough. Examples are shown in FIGS. 11–12, where the lower surface 3 of either side of the barrier is tight. (2) To strengthen the surface of the crest 2, which always will remain uncovered by drift material, even when the slopes 5 on both sides are covered, this surface also may be at least comparatively tight and smooth.

To prevent the fill material 19 in the upper part of the cells or the tangle from being washed out, some kind of means allowing for downward, but hindering upward passage of the fill 19, may be supplied to the upper surface. For example, a membrane provided with rows of short slits may be attached to the surface. The thickness of the membrane should be adjusted so that the slits open up, when a certain height of fill 19 is placed on top of the membrane, but keeps closed when exposed to wave action.

Appropriate materials for fabrication of the porous structure 1 may be synthetic, e.g. polypropylene or polyethylene, chips of metal or other waste material, or natural fibres such as coco fibres coated with synthetic or natural rubber or plastic.

The best manner of installing the barrier structure depends on the local conditions and the type of material used for fabrication of the barrier.

A more or less rigid structure may be floated to the installation site, where it is sunk and filled with ballast material.

A more advantageous method normally is to fabricate the barrier from flexible material that can be wound around a reel 32, so that it can be rolled off from a surface vessel, or even better, from an underwater sled 40, FIGS. 2–6, or vehicle supplied with wheels, caterpillars or longitudinal, rotating cylinders with screw thread, fore and/or aft, and which may be pulled along via a rope 46 by a winch on shore or by a surface vessel, or may be self-propelled and/or remotely controlled. In the last-mentioned cases the highest degree of independence of weather conditions is obtained.

On land the barrier material may be rolled off from a vehicle. When a barrier structure as the one shown in FIG. 9 is to be flattened out before winding up on a reel, the edge portions 14 are to be turned about 180 degrees away from the barrier, so that the barrier structure becomes nearly plane, whereas sharply edged portions are to be pressed directly against the adjacent portion 13, so that they become nearly plane and level with 13.

The sled 40, FIGS. 2–6, may have several functions: A sheet that is not pre-shaped, may be gradually shaped into the desired cross-section of the barrier, e.g. the one shown in FIG. 1, by means of guiding members 33, FIG. 5. As the sheet 13 rolls off the roll 32, which may be provided with brake means, and passes through the sled 40, the system of longitudinal and crosswise guiding members 33 with successively differing cross-sections gradually bends the edge portions of the sheet 13 around to form the lower ballasted horizontal portions 16, and successively transforms the sheet from its plane shape at the roll 32 to the desired almost closed cross-section, FIG. 1, where the sheet passes the rear end of 33. The shaping members 33 may contain hinges 47, so that the resulting shape of the barrier is adjustable.

Figure 4:
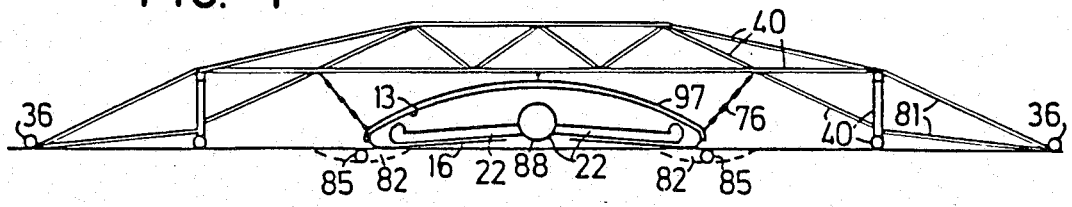
FIG. 4 is a section along the line II—II of FIG. 2.
Figure 5:
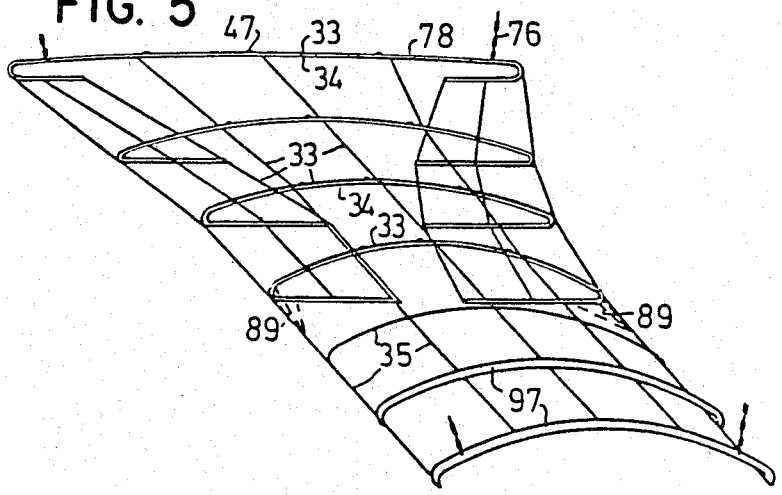
FIG. 5 is a perspective view of a barrier-shaping device of the sled shown in FIGS. 2–4.

The rear end of the sled 40, FIG. 4, prevents deformation of the barrier during the filling of this with ballast material.

Furthermore, the sled may include the pumping or plowing means used for filling the barrier.

The sled may also include sonars and/or underwater television cameras to monitor the filling process. Such devices for instance may be mounted on the sled 88, FIG. 2.

The shaping members appropriately are assembled to form one unit 33, which may be hanging in chains 76 from the sled 40. If the sheet material 13 is very flexible, supplementary guiding members 34 underneath 33 may be required to steer the sheet during the laying process. At least part of the assembly of separate members 33 or 34 may be replaced by continuous plate. To allow for initial manual feeding of the sheet 13 through the narrow slit 78 between the upper (33) and lower (34) sets of guiding members, hinges 47 may be required.

The upper part 35 of the framework 33 may be extended toward the rear end of the sled 40 where it maintains the outer shape of the sheet 13 during the filling of this. Alternatively, such shaping members may be in fixed connection with the sled 40. To eliminate friction, the members and/or the guiding members 33, 34, 35 may be supplied with rollers.

As the filling process may not be completed before the sled 40 has passed the section that is being filled, an extra sled may be pulled along some distance behind the sled 40, in order to shape the desired configuration of the barrier.

The ballast material 19 may be supplied through a hose from a surface vessel or, preferably, be taken from the adjacent seabed area. In the latter case the sediment may be plowed from this area into the hollow in, respectively up upon the upper surface of, the barrier, by means of at least one pair of long plow shares which form a suitable angle with the sled 40. The material 19 thereby can be lead into the space under the sheet 13, FIG. 1, or up on top of the sheet, FIGS. 8–12.

Wherever possible, pumping of the sediment 19, however, is preferable. The pumping equipment 80 may be installed on the surface vessel or, preferably, on the sled 40, FIGS. 2–3.

Figure 6:
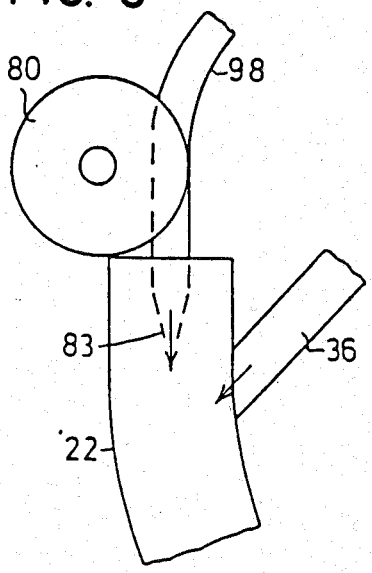
FIG. 6 is a section through a preferred type of pump.

An appropriate type of pump is shown in FIG. 6. The pump 80 produces a high speed jet of water through the nozzle 83 and thereby draws big volumes of water/sediment mixture with lesser velocity through the pipes 36.

The percentage content of water in the water/sediment mixture may be controlled by valved side openings somewhere in the system of mouthpieces 45, hoses and/or pipes 36 and pump.

If the sediment 19 is taken from the adjacent seafloor, it should, generally, be picked up as far away from the barrier as possible. The hoses or pipes 36 through which the sediment is drawn from the seafloor, therefore may be mounted on extended frames 81. These may be in hinged connection with the sled 40, so that they can yield in case they hit obstacles on the seabed.

To minimize the depth of the excavations caused by the removal of sediment, each hose or pipe 36 may split up and end with a plurality of parallel hoses or pipes 36, and/or end in wide, flat mouthpieces 45, so that the sediment is taken from a wide area.

Depending on the rigidity of the sheet 13, it may in some cases be desirable or necessary to draw part of the sediment 82, FIG. 4, through hoses or pipes 85 from the seabed along the edges of the barrier, so that the edges consequently will sink, and the desired streamlined cross-section of the barrier and/or the necessary strain in the sheet 13 is obtained.

Filling with sediment 19 of barrier structures as shown in FIGS. 8–12 may be achieved by jetting the water/sediment mixture directly from the adjacent seabed up upon the upper surface of the barrier structure. Structures with normally inaccessible spaces for ballast material 19 as shown in FIGS. 8 and 9 may be filled by means of hoses and/or pipes 86 which force the elastic upper portion 14 or 15 away from the barrier during their passage and lead the water/sediment mixture into the spaces to be filled. Then the elasticity of the sheet 13, 14, 15 will make the portions 14 or 15 bend back to the original position, so that the space is closed and prevents the sediment 19 from becoming washed out.

A barrier structure as shown in FIG. 1 has to be filled with sediment 19 through the front end of the sled 40, accordingly as the sled moves forward, and the filling hose and/or pipe 22 being carried or dragged along underneath the sheet 13 and between the two portions 16. All or most of the water of the sediment/water mixture may have to escape in forward direction through the same opening between the two portions 16. Hereby a fraction of the sediment of the mixture will deposit in front of the sled 40, so that the lower portions 16 of the sheet will be slanting downwardly toward the edges of the barrier, FIG. 4.

A rigid pipe 22 may be mounted in fixed connection with the sled 40 at a certain distance above the floor. A hose or flexible pipe 22 may be dragged along on the floor. In both cases a proper filling and tight packing of the full cross-section of the barrier may require that the flow of water/sediment mixture is distributed over the cross-section by means of a plurality of hoses or pipes, which may end in diffusers, preferably so that the total cross-section area of the hoses or pipes gradually increase toward the downstream end.

The assembly of hoses or flexible pipes 22 may be mounted on members 87 hinged to a sled 88 dragged along on top of the lower portions 16, which thereby will be kept in place, even if they have a positive buoyancy. The pivotal connection of the member 87 allow the sled 88 to be put through the opening between the two portions 16, even if these are made of rather rigid material.

For decrease of the velocity of the flow of sediment-/water mixture when it leaves the hoses or pipes 22, so that the sediment can deposit, the directions of the downstream ends of these hoses or pipes should be adjustable.

These directions may for instance be upwards and more or less backwards toward the rear end of the sled 40, to ensure filling of the top of the barrier.

Another principle which may be combined with the first one, is arrangement of the downstream ends of the hoses or pipes 22 two and two opposite each other, so that the outflows meet and neutralize eachother.

If the sheet 13 consists of filter cloth or of perforated material in which the perforated holes are covered with filter cloth, e.g. in the form of a continuous cloth underneath the perforated material, a compact filling of the top of the barrier can be achieved by drawing the superfluous water out through the filter cloth. This excessive water may be sucked out for instance by a pipe 97, FIGS. 1, 2, 5, with a longitudinal profile identical with the upper surface of the desired cross-section of the barrier. Its underside is perforated with holes, and may be provided with one continuous or several separate mouthpieces like those of a vacuum cleaner. Besides removing the superfluous water, such pipe at the same time shapes the barrier.

Preferably the superfluous water is drawn by the pump 80 through the hose or pipe 98, so that the water is recycled by the same pump in an almost closed flow system.

This system should be closed as completely as possible, so that a minimum of the surrounding water outside the system becomes involved, and the required pumping capacity for suction through the sheet 13 thereby is minimized.

The hoses or pipes 36 and/or 85 therefore may be connected to the pipes 97, e.g. by ending 36 and/or 85 as connections to 97, and by sucking the sediment from the seafloor through side openings on the underside of 36 and/or 85, so that to some extent it is the water sucked out through 97 that carries the sediment to fill the barrier.

Additionally, the outlets of the pipes or hoses 50 may be very close to the pipes 97 and point directly in direction of these. The outlets may match the sucking members 97 completely. If these are formed as pipes 97 as shown, the outlets of 50 may also be interconnected by perforated pipes of the same shape as 97 and move close to the sheet just below 97. The outlets of 50 or such interconnecting pipe may even be provided with flexible diffuser heads made for instance of rubber, which move in tight-fitting contact with the underside of the sheet 13 and exactly opposite the sucking members 97 on the other side of the sheet 13. The flexibility of the diffusers on their rear side allows for escape of the supplied sediment.

Suction through the filter cloth not only allows for compact, but also for fast filling of the barrier, because high velocity of the outflow is no hindrance for settling of the sediment particles in such case. To maximize the velocity, additional pumping capacity for suction of the superfluous water may be required.

Holes 38 through the sheet 13 may for example be produced continuously by means of a pair of rollers 39 mounted on the sled 40. One of the rollers is supplied with short spikes punching through the sheet 13 when it passes between the two rollers, the other roller being supplied with holes matching the spikes.

The sled 40 may consist of valved pipe members, which may be emptied of water, so that the sled becomes buoyant and able to float on the surface, when the sled is to be moved from one installation site to the next.

The cost of the sheet material 13 constituting an essential part of the total cost, re-use of the sheet may be wothwhile when more layers of deposited sediment on top of eachother are required.

Figure 14:
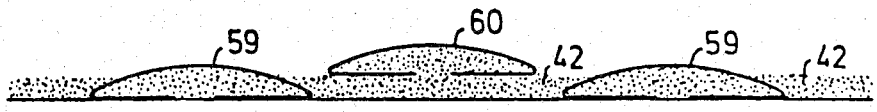
FIG. 14 is a cross-section of three parallel barriers.

For reversing the process, i.e. for loosening and collecting the sheet material 13 already installed, a backwardly moving sled 40 of principally the same design as the one described above, may be appropriate. By moving the sled backwards on top of the deposited sediment 42, FIG. 14, and by lowering the system of guiding members 33, 34, which should be supplied with plow shares 89, FIG. 5, through the deposition 42 to the lower side of the lower portions 16 of the structure 13, the plow shares and the members 33, 34 will raise and unfold the sheet 13. If necessary, the loosening of the sheet may be facilitated by means of water jets removing the deposits 42 along the sides of the barrier. The jet means may be mounted on either side of the sled 40.

When a sheet 13 is to be re-used on top of the deposition 42, two sleds 40 in succession may be used. The front sled moves backwards, so that it loosens, raises and unfolds the sheet. The next sled moving forwards takes over, folds, lays and fills up the sheet with sediment 19, on top of the deposition 42. Alternatively, the front sled only loosens and raises the sheet, without unfolding it, and the second sled only lays and fills it with sediment. To level off the seabed after the passage of the front sled, a scraper may be moved along between the two sleds. The two sleds may be joined together to form one apparatus.

Figure 7:
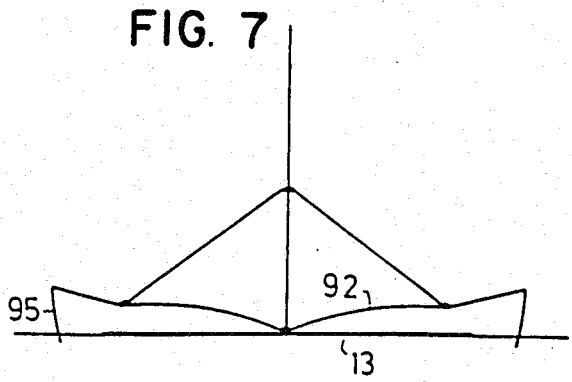
FIG. 7 is a cross-section of an alternative grab-type device for filling and shaping the barrier.

In particular for smaller structures, grabbing of the fill material may be an alternative to filling the structure 13 with sediment by pumping. The sheet 13 may be laid flat on the ground. The sled 40 may be supplied with a row of grabs 92, FIG. 7. Each grab being provided with one or more hinges, the edge portions 95 of such grab are pressed down into the ground material on either side of the sheet 13, when the center portion of the grab is lifted. The grab in this way clutching the sheet 13 and a portion of the ground material will gradually assume and fill the desired profile, e.g. the one shown in FIG. 1.

To prevent the water waves from flapping the sheet 13, and/or from undermining the barrier, at least sections of the barrier may be covered by a wide ballasted mat, e.g. of the type disclosed in PCT Application No. DK/80/00068.

INDUSTRIAL APPLICABILITY

Used as a submarine barrier, the above structure among other aspects opens up for a new method of protecting coasts against erosion. And the inexpensiveness of the structure allows for protection of long continuous coast sections on a large scale.

Figure 13:
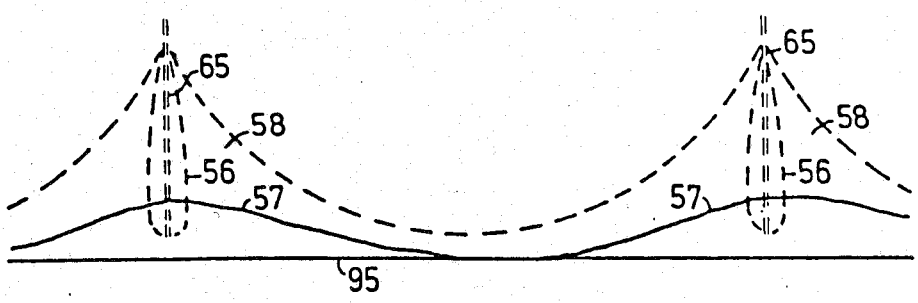
FIG. 13 is a plan view of a coast protected by barriers placed at intervals along the coast.

Perpendicular or possibly parallel to the coastline long submarine barriers 65 may be placed at long intervals, FIG. 13.

The landward end of each barrier may be placed some distance from the shoreline 95. The littoral drift will deposit sediment 56 along both sides of the barrier. Consequently, the waves will be refracted and cause the area 57 between the landward end and the shoreline to shoal. And deposition will take place in the areas 58 on both sides of the barrier. A partly submerged headland 57, 58 thereby is created, the littoral drift is minimized, and the coast between the headlands created this way is stabilized.

Depending on the dimensions of the barrier, the depths of water, the wave climate and current conditions on the site, one barrier may not be sufficient to hold the individual coast-section. And two or more parallel barriers 59, FIG. 14, with suitable mutual spacing may be required.

With time the height of the deposition, if necessary, may be increased by raising the barriers, or by placing a third barrier 60 on top of the deposition of sediment caused by the first two barriers 59 between these.

Figure 15:
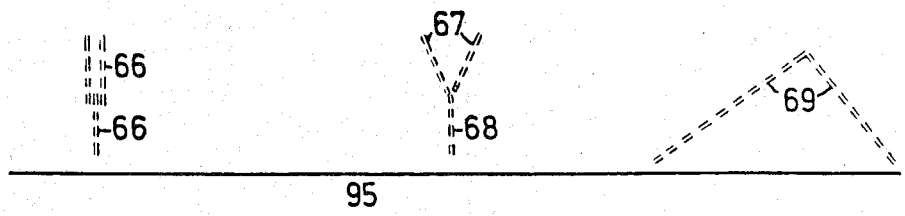
FIG. 15 is a plan view of a coast protected by assemblies of barriers with different layouts.

The number of parallel barriers 66, FIG. 15, may vary from the landward to the seaward end of the headland. Depending on the local conditions, the number may increase in the seaward direction, FIG. 15, or in the landward direction.

Furthermore, such assembly of adjacent barriers may not be parallel, but converge in either the seaward or the landward direction. FIG. 15 shows an example where two barriers 67 converging in the landward direction together with a third barrier 68 form a Y. FIG. 15 also shows an example where two barriers 69 converge in the seaward direction.

For prevention of siltation in a waterway, the barrier is placed along both sides of the channel.

If there is any tidal range in the channel, the channel may be maintained by the tidal current, and even deepened, by means of barriers placed parallel with, oblique to or perpendicular to the channel on its both sides. Due to the shallowing of the sides of the channel, the tidal current will deepen and maintain the middle part of the channel.

I claim:

1. A method of producing and laying on the ground an elongated structure consisting of at least one layer of flexible, tight and/or permeable and/or porous sheet material (13, 14, 16, 1), which forms at least one longitudinal hollow filled with sedimentary ballast material (19), characterized by a procedure comprising the following steps:

unrolling from a roll (32) said sheet material in its longitudinal direction;

advancing said roll in pace with the speed of said unrolling of said sheet material;

shaping said sheet material into a tube-like configuration comprising at least one longitudinal hollow, in which the underside of said tube-like configuration is provided with at least one opening allowing for passage of said sedimentary ballast material;

laying the tubelike configured sheet material on the ground with the opening bottommost;

and filling said hollow with sedimentary ballast material through said opening in the underside of the unrolled, but not yet laid portion of said sheet material.

2. The method as defined in claim 1 wherein the filling step is performed by pumping a suspension of the sedimentary ballast material into said hollow.

3. The method as defined in claim 1 wherein the sedimentary ballast material includes particles of ballast material and suspension fluid, and at least portions of the sheet material are permeable enough to allow for passage through the sheet material of the suspension fluid, but retain at least some of the particles of ballast material.

4. The method as defined in claim 3 including the step of sucking at least part of the suspension fluid from the hollow out through the porous sheet material.

5. The method as defined in claim 4 including the step of recirculating the fluid that is sucked out of the hollow back into the hollow to establish a generally closed circulation system.

6. The method as defined in claim 5 including the step of conducting the recirculated fluid along the ground wherefrom it entrains sediment on its way back to the hollow.

7. A method of constructing a barrier upon an underwater surface comprising the steps of progressively positioning spaced longitudinal slot-defining edge portions defining the underside of an elongated tube upon an underwater surface, and thereafter delivering ballast material through and between the spaced edge portions into the tube and into overlying relationship upon the edge portions to hold the edge portions upon the underwater surface.

8. The method as defined in claim 7 including the steps of forming the elongated tube by unrolling sheet material from a roll in its longitudinal direction, and advancing the roll in pace with the speed of the unrolling of the sheet material.

9. Apparatus for producing and laying on the ground an elongated structure formed of at least one layer of flexible, tight and/or permeable and/or porous sheet material which forms at least one longitudinal hollow filled with sedimentary ballast material comprising means for unrolling from a roll sheet material in its longitudinal direction, means for advancing the roll in pace with the speed of unrolling of the sheet material, means for shaping the sheet material into a tube-like configuration having at least one longitudinal hollow in which the underside of the tube-like configuration is provided with at least one opening allowing for passage of the sedimentary ballast material, means for laying the tube-like configured sheet material on the ground with the opening bottommost, and means for filling the hollow with sedimentary ballast material through the opening in the underside of the unrolled but not yet laid portion of the sheet material.

10. Apparatus for constructing a barrier upon an underwater surface comprising means for progressively positioning spaced longitudinal slot-defining edge portions defining the underside of an elongated tube upon an underwater surface, and means for thereafter delivering ballast material through and between the spaced edge portions into the tube and into overlying relationship upon the edge portions to hold the edge portions upon the underwater surface.

11. The apparatus as defined in claim 10 including means for forming the elongated tube by unrolling sheet material from a roll in its longitudinal direction, and means for advancing the roll in pace with the speed of the unrolling of the sheet material.

12. The apparatus as defined in claim 10 wherein said ballast delivering means is operative for delivering sufficient ballast to additionally fill the tube.

13. The apparatus as defined in claim 10 including means for storing sheet material as a web, and means for continuously forming the web into the elongated tube.

14. The apparatus as defined in claim 10 including means for storing sheet material as a rolled web, means for unrolling the web, means for continuously forming the web into the elongated tube, and said ballast delivering means being operative for delivering the ballast through a portion of the elongated tube which is unrolled but not yet positioned upon the underwater surface.

15. The apparatus as defined in claim 14 including means for guiding the web edge portions from maximum transversely spaced parallel relationship through an arc of converging relationship to form the elongated tube at which the web edge portions are again parallel but in immediately adjacent relationship.

16. The apparatus as defined in claim 10 including means for storing the sheet material as a rolled web, and means for forming the web into the tube.

17. A method of producing and laying on the ground an elongated structure consisting of sheet material forming at least one longitudinal hollow filled with sedimentary ballast material characterized by a procedure comprising the following steps:

unrolling from a roll the sheet material in its longitudinal direction;

advancing the roll in the pace with the speed of the unrolling of the sheet material into a tube-like configuration comprising at least one longitudinal hollow in which the underside of the tube-like configurations provided with at least one opening allowing for passage of the sedimentary ballast material;

laying the tube-like configured sheet material on the ground with the opening bottommost; and filling the hollow with sedimentary ballast material through the opening in the underside of the unrolled portion of the sheet material.

18. A method of constructing a barrier upon an underwater surface comprising the steps of progressively positioning spaced longitudinal edges of sheet material into spaced relationship to each other and upon an underwater surface to thereby form a tube with a longitudinal slot at an underside thereof, and as the tube is being progressively formed delivering ballast material through the longitudinal slot into the tube and into interior overlying relationship upon the edge portions of the tube to hold the tube edge portions upon the underwater surface.

* * * * *